US010018453B1

(12) United States Patent
McCoy et al.

(10) Patent No.: US 10,018,453 B1
(45) Date of Patent: Jul. 10, 2018

(54) LIGHTWEIGHT MONOLITHIC WARHEAD AND A METHOD OF MANUFACTURE

(71) Applicant: LOCKHEED MARTIN CORPORATION, Bethesda, MD (US)

(72) Inventors: Ryan Alexander McCoy, Orlando, FL (US); Edward W. Sheridan, Orlando, FL (US); Matthew Kelley, Orlando, FL (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 196 days.

(21) Appl. No.: 14/687,539

(22) Filed: Apr. 15, 2015

Related U.S. Application Data

(60) Provisional application No. 61/979,858, filed on Apr. 15, 2014.

(51) Int. Cl.
*F42B 12/24* (2006.01)
*F42B 33/00* (2006.01)

(52) U.S. Cl.
CPC ..... *F42B 12/24* (2013.01); *F42B 33/00* (2013.01)

(58) Field of Classification Search
CPC ..... F42B 12/22; F42B 12/24; F42B 12/26; F42B 12/28; F42B 12/32
USPC ..... 102/493, 494, 495, 496, 497
See application file for complete search history.

(56) References Cited

U.S. PATENT DOCUMENTS

| | | | | | |
|---|---|---|---|---|---|
| 3,298,308 | A * | 1/1967 | Throner, Jr. | F42B 12/32 | 102/496 |
| H238 | H * | 3/1987 | Adams | F42B 12/28 | 102/493 |
| 5,095,821 | A | 3/1992 | Merz | | |
| 5,117,759 | A * | 6/1992 | Henderson | F42B 12/32 | 102/473 |
| 7,093,542 | B2 | 8/2006 | Gousman et al. | | |
| 8,272,330 | B1 | 9/2012 | Gold et al. | | |
| 8,381,657 | B1 * | 2/2013 | Hooke | F42B 8/26 | 102/481 |
| 8,513,562 | B2 | 8/2013 | Bichsel | | |
| 8,689,669 | B2 | 4/2014 | Ronn et al. | | |
| 2006/0288897 | A1 * | 12/2006 | Williams | F42B 12/22 | 102/364 |
| 2009/0211484 | A1 * | 8/2009 | Truitt | F42B 12/32 | 102/497 |
| 2012/0090491 | A1 | 4/2012 | Young | | |
| 2014/0360635 | A1 | 12/2014 | Alven | | |
| 2015/0316359 | A1 * | 11/2015 | Hales | F42B 33/00 | 175/4.57 |

* cited by examiner

*Primary Examiner* — Bret Hayes
(74) *Attorney, Agent, or Firm* — Terry M. Sanks, Esq.; Beusse Wolter Sanks & Maire, PLLC

(57) ABSTRACT

A fragmentable package for use in an explosive armament, is disclosed having individual fragments formed by additively depositing layers, of at least one of selected metal type and a composite that includes a selected metal type, to create interconnected individual fragments to form a plurality of voids around an individual outer surface of the individual fragments defining a separation of fragments when detonated, the individual fragments providing structural stiffness and strength. A method is also disclosed.

20 Claims, 8 Drawing Sheets

LIGHTWEIGHT MONOLITHIC WARHEAD AND A METHOD OF MANUFACTURE

CROSS-REFERENCE TO RELATED APPLICATIONS

This application claims the benefit of U.S. Provisional Application No. 61/979,858 filed Apr. 15, 2014 incorporated herein by reference in their entirety.

BACKGROUND

Embodiments relate to a warhead and, more particularly, to a fragmentable package within a warhead that has individual interconnected fragments having a pattern with a plurality of voids defining the pattern.

The primary lethal mechanism of a fragmented warhead is the kinetic energy of the shattered casing fragments or pre-formed "frag pack" fragments rather than the heat or overpressure, or blast overpressure, caused by the detonation. An existing problem associated with typical preformed fragment warheads is that the mass of the fragments does not contribute to structure stiffness and strength. More specifically, the mass of the preformed fragment warhead is usually parasitic and does not contribute to airframe performance over the life of a. delivery device, such as, but not limited to, a missile, a rocket, a drone, etc. Additionally, preformed fragmentable packages within the warhead may also be susceptible to vibration and shock environments and have a lot of mass with a lower natural frequency.

Currently, an ability to produce varied fragmentable designs has been limited due to manufacturing technologies. Traditional manufacturing has been labor and process intensive since fragmentable packages are usually hand packed whereas other applications involve casting fragmentable packages in a binder, which may result in less density of the individual fragments and thus less efficient warheads.

Manufacturers and users of fragmented warheads would benefit from warheads with fragmentable packages which contribute to structural stiffness and strength of the warhead where the fragmented warhead is lightweight, when compared to prior warheads, and are not fully parasitic during a lifetime of the warhead and its delivery system.

SUMMARY

Embodiments relate to a system, such as, but riot limited, to a warhead, and a method for providing a fragmentable package for use in a warhead. A fragmentable package for use in an explosive armament comprises individual fragments formed by additively depositing layers, of at least one of selected metal type and a composite that includes a selected metal type, to create interconnected individual fragments to form a plurality of voids around an individual outer surface of the individual fragments defining a separation of fragments when detonated. The individual fragments provide structural stiffness and strength.

The method comprises additively depositing a plurality of layers, of at least one of selected metal type and a composite that includes a selected metal type, to create a fragmentable package for an explosive having a pattern with voids between individual fragments of the fragmentable package defining a separation of fragments when exploded. The method also comprises controlling positioning of the deposition of the layers to build a structure with the pattern so that the fragmentable package provides for a structural stiffness and strength sufficient for use with a delivery system.

BRIEF DESCRIPTION OF THE DRAWINGS

A more particular description briefly stated above will be rendered by reference to specific embodiments thereof that are illustrated in the appended drawings. Understanding that these drawings depict only typical embodiments and are not therefore to be considered to be limiting of its scope, the embodiments will be described and explained with additional specificity and detail through the use of the accompanying drawings in which.

DETAILED DESCRIPTION

Figure 1:
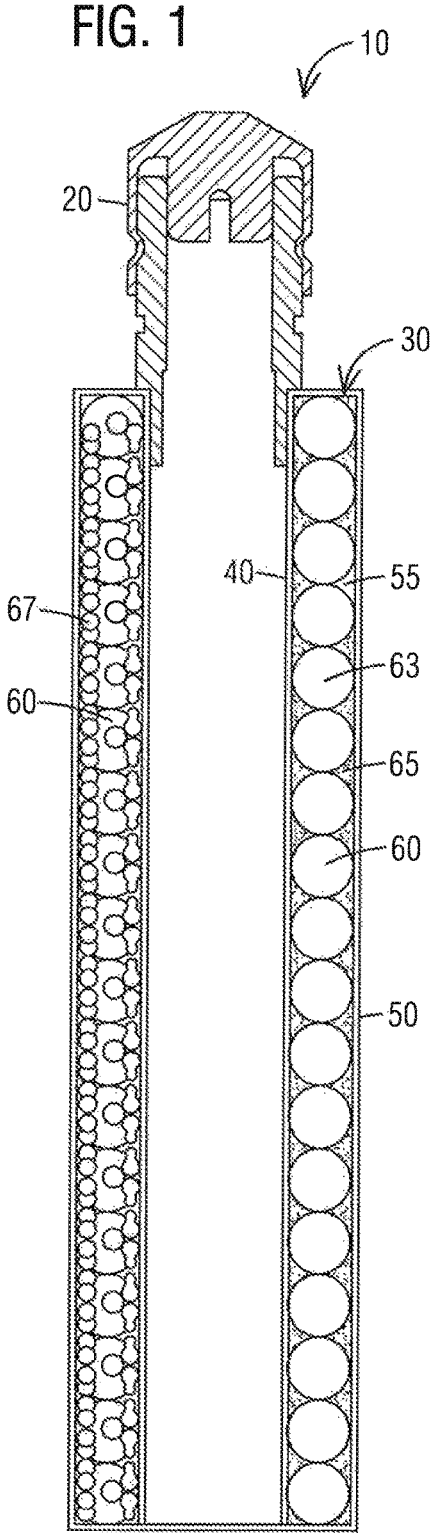
FIG. 1 shows a cross section of an embodiment of a warhead.

Embodiments are described herein with reference to the attached figures, wherein like reference numerals, are used throughout the figures to designate similar or equivalent elements. The figures are not drawn to scale and they are provided merely to illustrate aspects disclosed herein. Several disclosed aspects are described below with reference to non-limiting example applications for illustration. It should be understood that numerous specific details, relationships, and methods are set forth to provide a full understanding of the embodiments disclosed herein. One having ordinary skill in the relevant art, however, readily recognizes that the disclosed embodiments can be practiced without one or more of the specific details or with other methods. In other instances, well-known structures or operations are not shown in detail to avoid obscuring aspects disclosed herein. The embodiments are not limited by the illustrated ordering of acts or events, as some acts may occur in different orders and/or concurrently with other acts or events. Furthermore, not all illustrated acts or events are required to implement a methodology in accordance with the embodiments.

Notwithstanding that the numerical ranges and parameters setting forth the broad scope are approximations, the numerical values set forth in specific non-limiting examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 4.

FIG. 1 illustrates a cross section of an embodiment of a warhead. As illustrated, the warhead 10 may comprise an igniter 20 which is located in proximity to a fragmentable package 30. An inner wall 40 and an outer wall 50 may surround the fragmentable package 30. Though both the inner wall and the outer wall are shown, only a single wall or no wall at all may be utilized in various embodiments. The fragmentable package 30 may comprise individual fragments 63, 67 which are layered by additively depositing layers to create individual interconnected fragments having a pattern with voids 55 defining the pattern so that the fragmentable package provides structural stiffness and strength independent of the inner wall and outer wall. The pattern may also provide for a defined separation of fragments when the fragmentable package is exploded. Non-limiting examples of the voids 55 comprises having a partly sintered space, comprising porous material within the space, or empty space. Therefore, the term "void" is not meant to be limited to suggesting empty space.

The voids 55 may also facilitate additional processing. As a non-limiting example the voids 55 may be used as channels for locating or receiving cabling, wiring, a wire, a wire harness, wiring connection, etc. that may be provided to connect other components, such as but not limited to a seeker to a guidance and control subsystem. The voids 55 may also be used to facilitate plating to prevent undesirable voids, as channels to facilitate material flow for casting, depositing, or injecting energetic reactant (or reactive), reactants or energetic material fills within the voids, etc.

Thus, in an embodiment, a thickness of at least one of the inner wall and the outer wall may be provided with a minimized thickness. As a non-limiting example the thickness of at least one or both walls may be of a thickness sufficient to cover at least a part of the fragmentable package 30. This configuration results in a lighter weighted warhead. The structural stiffness and strength provided by the fragmentable package may provide a requite strength and stiffness for use with a designated delivery system, such as, but not limited to, a missile.

The fragmentable package 30 as disclosed herein may further reduce parasitic mass, that is, mass that does not provide structural benefit. The fragmentable package may further provide for a minimized thermal conductivity due to at least the voids 55. The minimized thermal conductivity may be based on at least one of a volume of the voids 55 and a conductivity of the voids 55. As described herein, the fragmentable package 30 may also be relatively insensitive to shock and vibration. Such insensitivity may be due, at least in part, to an interconnection of the individual fragments 60.

The individual fragments 60 may comprise non-symmetric or symmetric fragment structure shapes, structures, or distributions (of a plurality of fragments). The individual fragments may be bi-modal or tri-modal configuration of fragments. As illustrated in FIG. 1, the fragmentable package 30 may comprise individual fragments 60 which are systematically linked or connected to respective adjacent individual fragments below the void 55. The cross section in FIG. 1 may be a fragmentable package illustrated in FIG. 3B which has large fragments and small fragments 67 distributed uniformly. However, as shown in FIG. 1, one side of the cross section is taken through the larger fragments 63 and the other side of the cross section is taken through the smaller fragments 67 of FIG. 3B. The fragmentable package 30 may comprise individual fragments 63 that are non-uniform fragment distributions when compared to all other individual fragments 67 within the warhead 10. However, in this configuration a uniform pattern or distribution of the various individual types of fragments 63, 67 are used.

Figure 2:
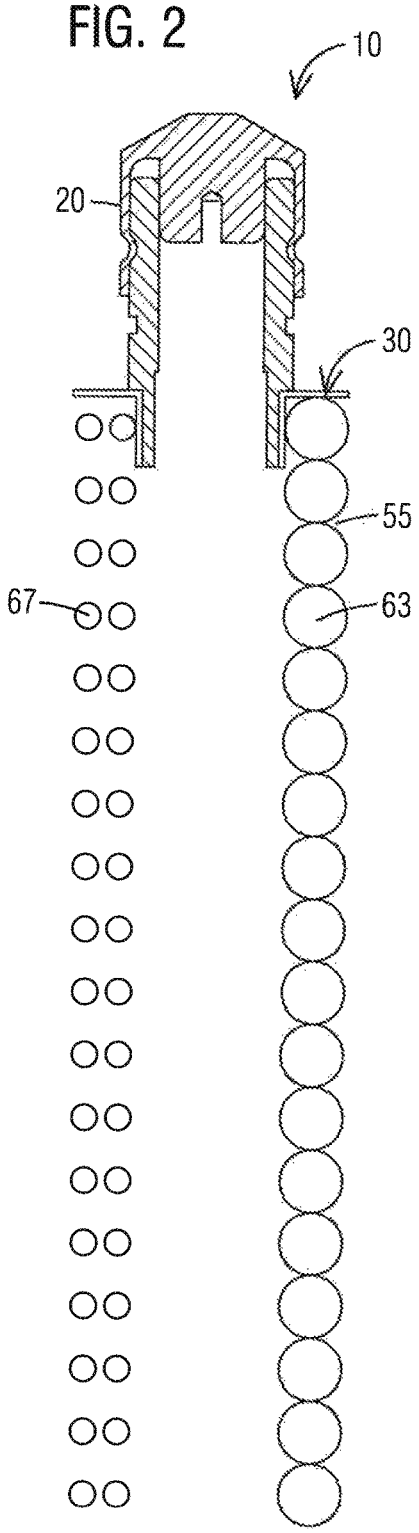
FIG. 2 shows another cross section of an embodiment of a warhead.

FIG. 2 shows another cross section of an embodiment of a warhead. In this embodiment, no inner wall or outer wall is shown. The fragmentable package 30 may comprise individual fragments 63 that are non-uniform fragment distributions when compared to other individual fragments 67 within the warhead 10. Such an arrangement is provided for in FIG. 4C, discussed further below. Thus, the individual fragments 60 may not be constructed where each has a uniform shape throughout the fragmentable package 30 or a similar distribution of fragments. Such shapes may include, but are not limited to rods, spheres, various prisms (such as, but not limited to including triangular, rectangular, hexagonal or any other regular polygon filings) and various polyhedral regular tessellations. Therefore, it may be possible to have fragments which may produce different directional fragment effects, such as, but not limited to, size distribution of fragments within the warhead 10 which may be designed for directionality and tailoring different direction for defeating different types of targets as well as fragment shape and ballistic coefficient. Asymmetric effects may be achieved based on a layout or design of the voids 55. Additionally, other energetics material or reactant materials, such as, but not limited to, thermite, titanium-boron, aluminum, zirconium, titanium, magnesium, etc. Exothermic intermetallic reactants such as titanium and boron, aluminum and nickel, etc. (intermetallic borides, carbides, and aluminides of titanium, zirconium, and nickel may be included in certain voids to also assist with directionality or tailoring direction of the warhead's explosion. In another non-limiting embodiment, the energetics material or reactant materials may be applied using at least one of, electroplating, electro-less plating, electrophoretic deposition, anodization/electrolytic passivation, etc.

A filler material 65 may be located within the void 55. Non-limiting examples of the filler material may include a phase-change material, coolant, propellant, reactant (such as, but not limited to, with a structural material), an energetic or explosive, etc. When the filler material 65 is the phase-change material, it may be a substance with a high heat of fusion which, melting and solidifying at a certain temperature, is capable of storing and releasing large amounts of energy. Heat may be absorbed or released when the material changes from solid to liquid and vice versa. The phase-change material may comprise a substance that is capable of absorbing thermal energy thus protecting the energetic or explosive during flight before detonation. In another non-limiting embodiment, the filler material 65 may be provided to increase a projection distance of the individual fragments 60, or certain individual fragments (based on a shape or size of the individual fragment) of the fragmentable package 30. The filler material 65 may cause secondary effect of an explosive or energetic after detonation, such as, but not limited to, acting as a second fuel and/or oxidizer (such as acting as a fuel air explosive or energetic). As the term is used herein, "filler material" is not meant to define any particular function or feature, but is primarily used to identify a material, or filler, which may be located within the voids 55 of the fragmentable package 30.

The warhead 10 may be created using metal laser sintering ("MLS"). MLS may include, but is not limited to, direct metal laser sintering, electron beam melting, selective laser sintering, etc., for additively depositing layers. As a non-limiting example, metal powder may be melted using precisely directed, high energy laser to create a structure which is fully dense, fine and homogenous. Non-limiting examples of metal powder that may be used (in combination or singularly), but is not limited to, include such ferrous metals as steel alloys, stainless steel, tool steel and such non-ferrous metals as aluminum (including an aluminum casting alloy), bronze, cobalt-chrome, titanium, tungsten (including a tungsten alloy), molybdenum, copper, ceramics, tantalum, etc. As used herein, though metal is expressly stated, the use of metal may include any of the materials listed above. Additionally, materials other than metal may be used, such as, but not limited to, a ceramic, a carbide laced with a metal, etc. Thus, the fragmentable package 30 is built layer-by-layer where the pattern and physical measurements are provided from a data. file, such as, but not limited to, a 3-dimensional computer aided design (CAD) data file. The inner wall 40 and outer wall 50 may also be created using MLS as disclosed above concurrent with creation of the interconnected fragments.

Figure 3A:
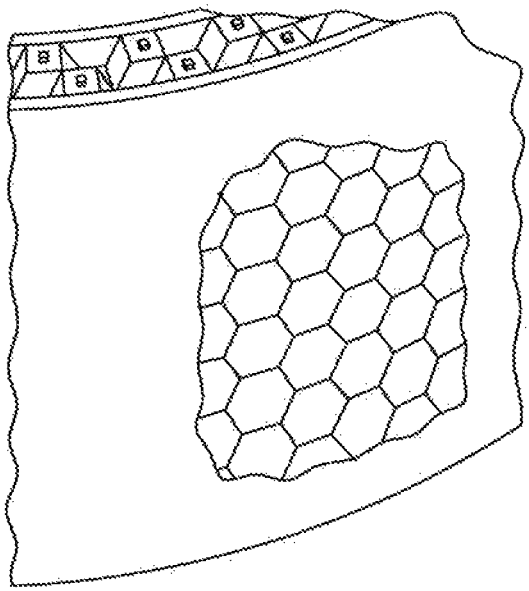
FIGS. 3A-3F show various embodiments of a fragmentable package of an embodiment of a warhead.
Figure 3B:
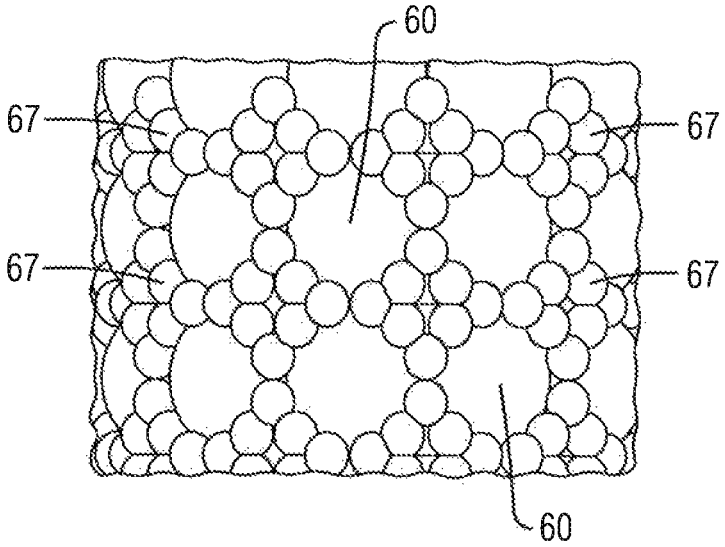
Figure 3C:
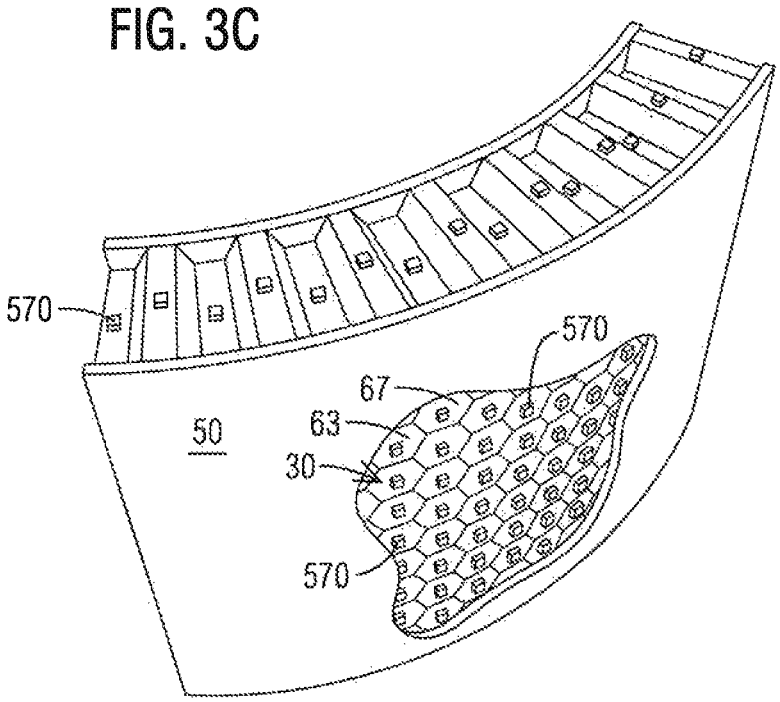
Figure 3D:
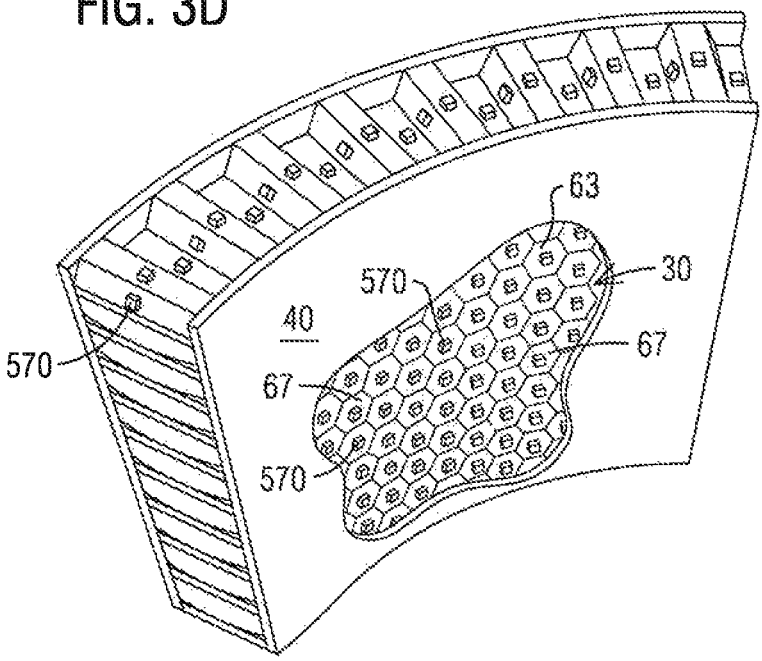
Figure 3E:
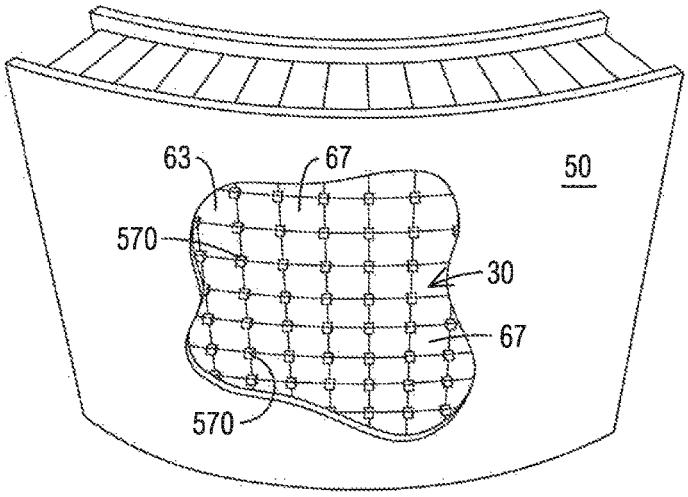
Figure 3F:
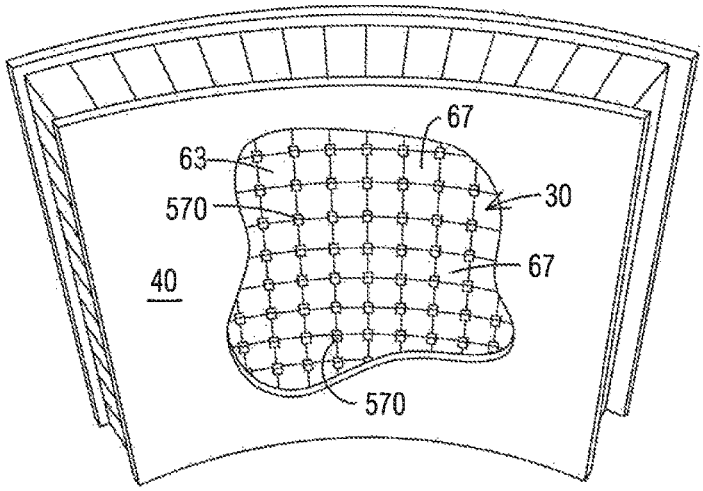

FIGS. 3A-3F illustrate various embodiments of a fragmentable package of an embodiment of a warhead. As illustrated, a pattern may be provided in the fragmentable package 30 that comprises voids 55, which. may have any one of the configurations disclosed herein. As further illustrated, the individual fragments 60 may have a plurality of sizes. FIG. 3A represents a fragmenting warhead in which frags are hexagonal prism that are layered in two layers around the high explosive or energetic. FIG. 3B represents a bi-modal fragmenting warhead in which the frags are spherical. FIG. 3B also shows that the individual fragments 60 may have a plurality of shapes as part of a fragmentable package. FIG. 3C shows a front view of a fragmentable package, with a part of the outer wall 50 removed, that has various hexagonal prisms fragments. FIG. 3D shows a back view of the fragmentable package of FIG. 3C, with a part of the inner wall 40 removed. FIG. 3E shows a front view of a fragmentable package, with a part of the outer wall 50 removed, that various rectangular prisms fragments. FIG. 3F shows a back view of the fragmentable package of FIG. 3E, with a part of the inner wall 40 removed. In FIGS. 3C-3F interconnectors 570 are also shown. The interconnectors 570 are discussed in further detail below with respect to FIG. 5.

FIGS. 4A-4E show various block diagrams of a cross section of an embodiment of a warhead. As illustrated in every figure, but FIG. 4D, an inner wall 40 and an outer wall 50 may be provided. As discussed above, each figure shows that the walls may be configured with only one or no walls. Likewise, FIG. 4D may be configured with either walls, or only one wall. Within the walls 40, 50 is a respective fragmentable package 30 in FIG. 4A, 31, 31', and 31" in FIG. 4B, 30' in FIG. 4C, 30" in FIG. 4D, and 30'" in FIG. 4E.

Figure 4A:
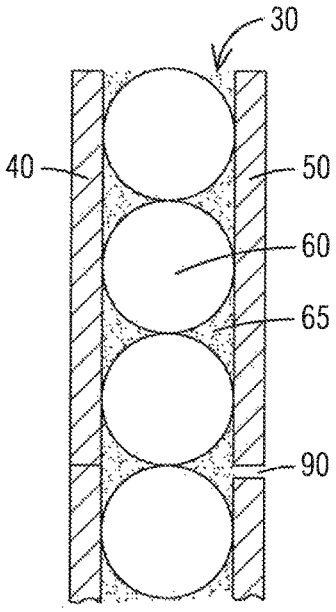
FIGS. 4A-4E show various block diagrams of a cross section of an embodiment of a warhead.

With respect to FIG. 4A, an opening or flow through cavity 90 may be provided to insert a filler material 65. The flow through cavity 90 may be a same cavity that may be provided to remove metal powder that was not melted during the MLS process or may be its own cavity independent of any other uses.

Figure 4B:
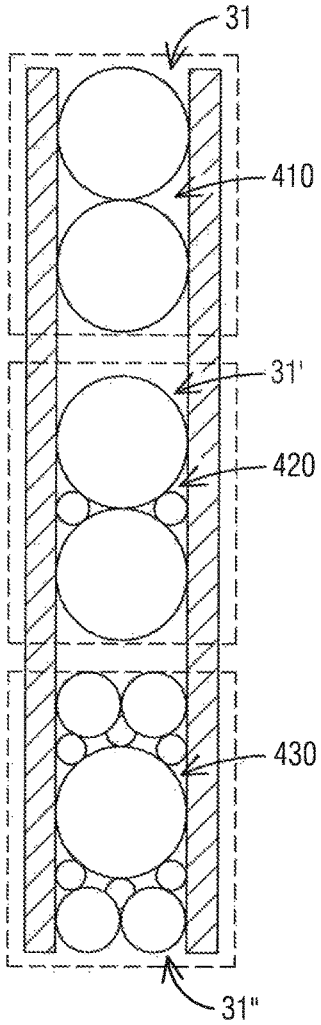

FIG. 4B shows a multi-mode warhead 10. As illustrated, the warhead 10 may have different segments 410, 420, 430, where each segment may have a different fragmentable packaged 31, 31' and 31", Each segment 410, 420, 430 may designate a different mode, such as, but not limited to, bi-modal and tri-modal in which there are a plurality of sizes of fragments in a warhead optimized towards multiple targets. Multi-mode warheads typically have a distribution of fragment sizes or shapes are varied in the fragmentable pack so as to be able to optimize for different types of targets (e.g. tank or armored vehicle vs softer targets).

Figure 4C:
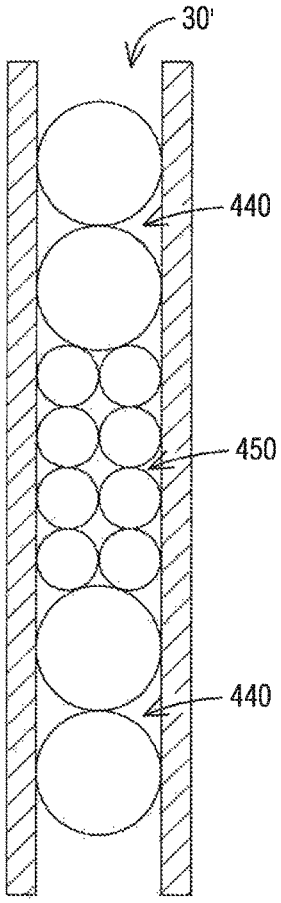
Figure 4D:
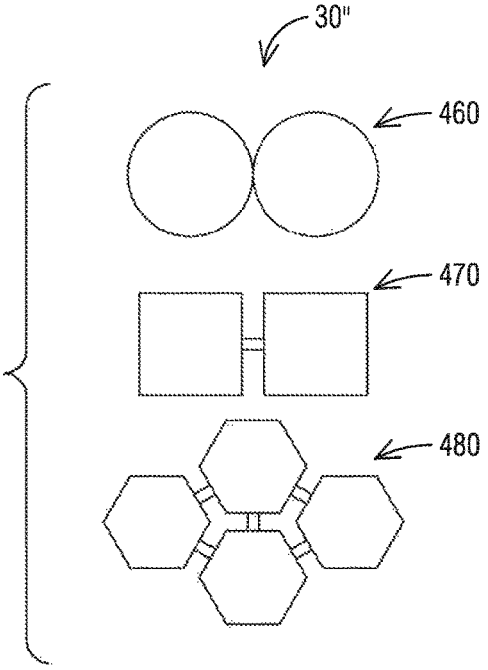
Figure 4E:
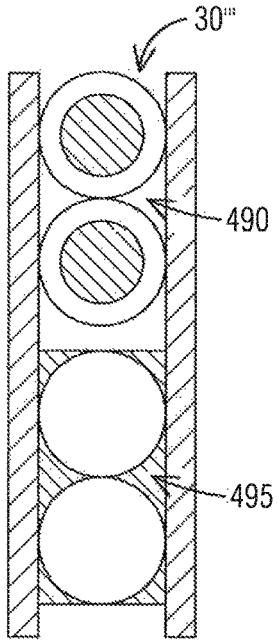

FIG. 4C shows a warhead with fragments of a particular spatial distribution. In this configuration, a plurality of distributions 440, 450 are used within a fragmentable package 30' within the warhead 10 to direct fragments during a single ignition of the warhead that may be selected to optimize warhead effectiveness on a certain class of targets. FIG. 4D shows an example of a plurality of fragment shapes 460, 470, 480. FIG. 4E shows fragment distributions 490, 495 with different partially sintered material forming the fragmentable package 30'" within the same warhead 10. Such a configuration may be used to vary strength and density of the fragment pack or the fragments themselves. For angular variation, the weapon can be re-oriented to face a specific sector of the frag pack towards a target. The orientation can be selected by the weapon so that the frags in the sector facing the target would have greater effectiveness against the target than the other frags in the frag pack, which would be optimized for a different target.

For variation in distribution along the length the timing of the detonation can be adjusted (e.g. earlier or later) so that the fragments in that particular length sector of the warhead may hit the target for which they were optimized. Based on the teachings herein, a plurality of designs may developed to provide for a desired separation of fragments of the fragmentable package.

Figure 5:
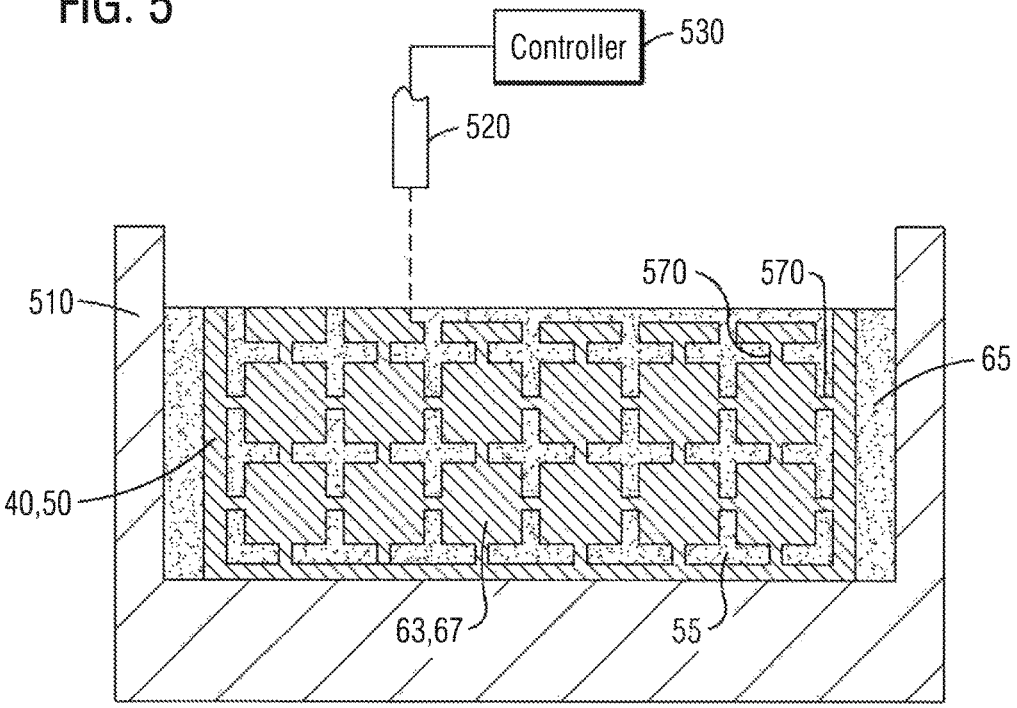
FIG. 5 shows a cross sectional view of a fragmented warhead may be created.

FIG. 5 shows a cross sectional view of how a fragmented warhead may be created. The figure represents the Metal Laser Sintering (MLS) process using a powder bed, however other methods of creating the structure of the warhead, including but not limited to Selective Metal Laser Sintering, etc. exist. As illustrated, a build chamber 510 may be provided. A method of sintering the material, such as, but not limited to, with a laser 520 may be used to additively sinter a selected metal type, laid down in layers through the process, to create a fragmentable package 30 having a pattern with voids 55 between individual fragments of the fragmentable package defining the pattern. As disclosed above, other layering techniques may alternatively be used. A controller 530, such as, but not limited to a computerized controller may also be provided to direct the pattern of sintering as well as various parameters of the laser. A filler material 65 may be injected or casted within the voids 55. Also, when a warhead wall 40, 50 is included, the wall may be built by additively depositing a plurality of layers of a selected material for the walls, simultaneously with the additively layering of the fragmentable package.

An interconnector 570 may be located between adjacent individual fragments 63, 67. The interconnector 570 may be formed by additively depositing layers. The interconnector 570 may be formed at the same time as the individual fragments 63, 67 are formed. Hence, though a same layering material and technique may be used, a same layering material and technique is not necessarily required. The interconnector 570 may comprise a smaller sized structure, or structured size, than the individual fragments 63, 67. The interconnector 570 may also be located between at least one of the inner wall 40 and the outer wall 50 and an adjacent individual fragment 63, 67.

As shown and disclosed herein, the fragmentable package 30 may comprises individual fragments 60 formed by additively depositing layers, of at least one of selected metal type and a composite that includes a selected metal type, to create interconnected individual fragments 60 to form a plurality of voids 55. The voids 55 may be located around an individual outer surface of the individual fragments 60 defining a separation of fragments for the fragmentable package 30 when detonated or exploded, the individual fragments 60 and voids 55 provide structural stiffness and strength. As shown, around the individual outer surface of the individual fragments comprises the voids 55 which are located along at least two dimensions of the three dimensions (length, width and depth) of the individual fragments 60.

Unlike prior art examples, the individual fragments disclosed herein are not required to be integral to a casing where the separation of the individual fragments is determined by controlling material thickness, density, ductility, etc. Instead, as taught herein, the interconnected individual fragments are provided so as to minimize material that does not contribute to a desired performance (such as providing for a parasitic weight towards zero). Additionally, shapes, size and distribution of the voids result in forming interconnected individual fragments to provide for desired effects or performance.

A fragmentable package 30 as disclosed herein is not limited for use in direct communication with a warhead. As a non-limiting example, the fragmentable package 30 disclosed herein may be used on other parts of a delivery systems, such as, but not limited to, a cruise missile or other missiles that may include wings which are parasitic weight. Thus, the wings may comprise the fragmentable package 30 as disclosed herein with energetic material within the voids 55.

Figure 6:
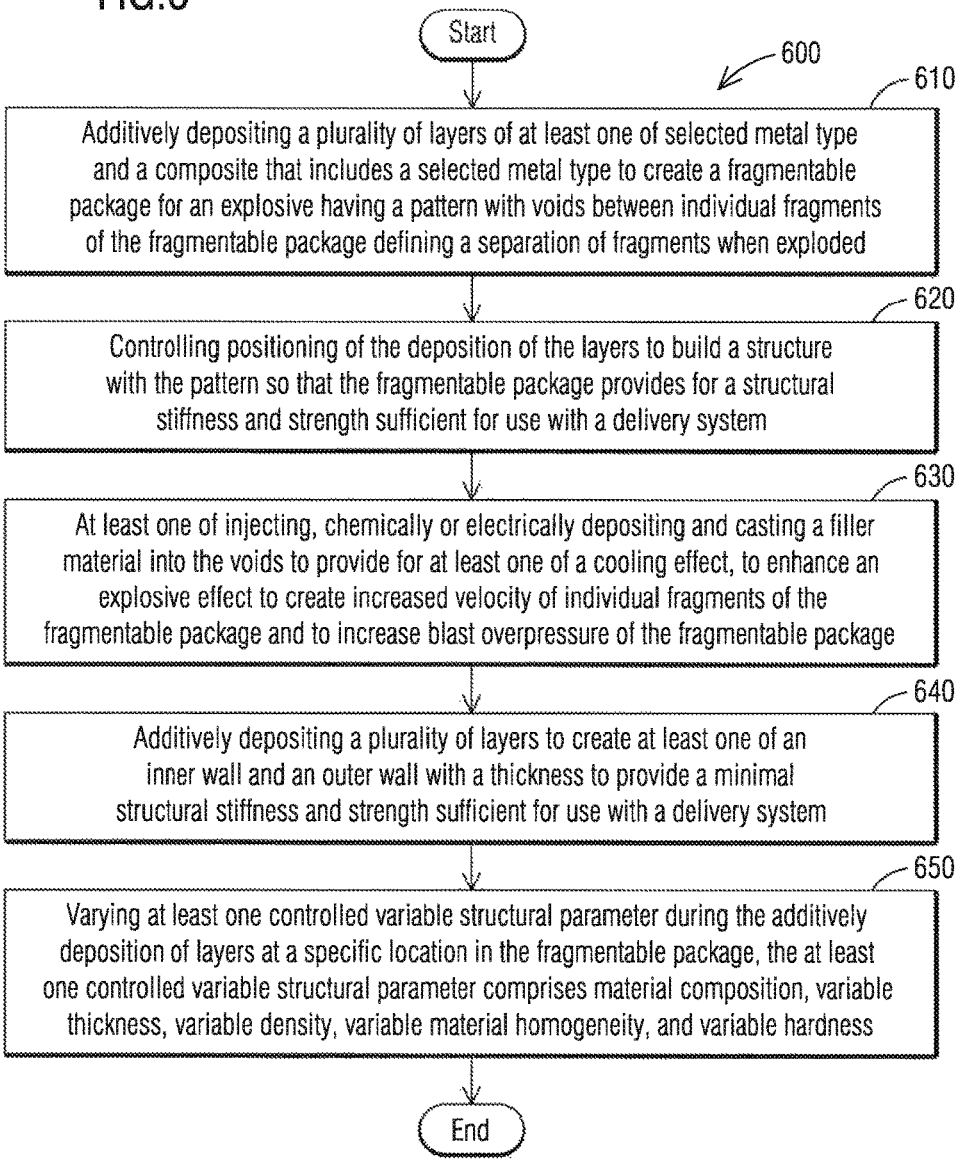
FIG. 6 illustrates a method for creating a fragmented warhead.

FIG. 6 shows a flowchart of a method. The method 600 may be used for creating a fragmented warhead. The method 600 comprises additively depositing a plurality of layers, of at least one of selected metal type and a composite that includes a selected metal type, to create a fragmentable package for an explosive having a pattern with voids between individual fragments of the fragmentable package defining a separation of fragments when exploded, at 610. The metal layers may be direct-manufactured metal layers. The method further comprises controlling positioning of the deposition of the layers to build a structure with the pattern so that the fragmentable package provides for a structural stiffness and strength sufficient for use with a delivery system, at 620. Controlling positioning of the deposition may be performed with the computerized controller 530 that is used in association with the laser 520.

The method may also comprise at least one of injecting, chemically or electrically depositing and casting a filler material into the voids to provide for at least one of a cooling effect and to enhance an explosive or energetic effect to create increased velocity of individual fragments of the fragmentable packaged, at 630. The method may also comprise additively depositing a plurality of layers (which may be direct-manufactured layers) to create at least one of an inner wall and an outer wall with a thickness to provide a minimal structural stiffness and strength sufficient for use with a delivery system, at 640. Additively depositing the plurality of layers to create at least the one of the inner wall and the outer wall may be done in conjunction with additively depositing the plurality of direct-manufactured metal lasers of the selected metal type to create the fragmentable package. As used herein in conjunction with or simultaneously may mean that the additive process may provide for both the fragmentable package and any wall to be built during a same process. As a non-limiting example, the laser 520 preforming the additive layering may transition from the wall to the fragmentable packaged during each layering step of both the fragmentable package and any wall at a same elevation. Thus, once a layer is provided to the fragmentable package, the laser may transition over to the wall to also deposit a layer of the material comprising the wall.

A thickness of either the inner wall or the outer wall, or both walls, may be of a minimal structural stiffness and strength dependent on the delivery system used with the warhead. The method may further comprise varying at least one controlled variable structural parameter during deposition of the additively deposed layers at a specific location of, on or in (each of these terms may be used interchangeably), the fragmentable package, the at least one controlled variable structural parameter comprises material composition, variable thickness, variable density, variable material homogeneity, and variable hardness, at 650. By varying the at least one controlled variable structural parameter, specific individual fragments could be produced to be frangible or less-than-lethal fragments. Though the steps of FIG. 6 are shown in a particular order, this order is not limiting as any order of the steps may be implemented.

While the disclosure provides illustrative embodiments, this description is not intended to be construed in a limiting sense. Various modifications and combinations of the illustrative embodiments, as well as other embodiments, will be apparent to persons skilled in the art upon reference to the description. It is therefore intended that the appended claims encompass any such modifications or embodiments.

While various disclosed embodiments have been described above, it should be understood that they have been presented by way of example only, and not limitation. Numerous changes to the subject matter disclosed herein can be made in accordance with the embodiments disclosed herein without departing from the spirit or scope of the embodiments. In addition, while a particular feature may have been disclosed with respect to only one of several implementations, such feature may be combined with one or more other features of the other implementations as may be desired and advantageous for any given or particular application.

Therefore, the breadth and scope of the subject matter provided herein should not be limited by any of the above explicitly described embodiments. Rather, the scope of the embodiments should be defined in accordance with the following claims and their equivalents.

The terminology used herein is for the purpose of describing particular embodiments only and is not intended to be limiting. As used herein, the singular forms "a," "an," and "the" are intended to include the plural forms as well, unless the context clearly indicates otherwise. Furthermore, to the extent that the terms "including," "includes," "having," "has," "with," or variants thereof are used in either the detailed description and/or the claims, such terms are intended to be inclusive in a manner similar to the term "comprising." Moreover, unless specifically stated, any use of the terms first, second, etc., does not denote any order or importance, but rather the terms first, second, etc., are used to distinguish one element from another.

Unless otherwise defined, all terms (including technical and scientific terms) used herein have the same meaning as commonly understood by one of ordinary skill in the art to which embodiments of the invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

While embodiments have been described with reference to various embodiments, it will be understood by those skilled in the art that various changes, omissions and/or additions may be made and equivalents may be substituted for elements thereof without departing from the spirit and scope of the embodiments. In addition, many modifications may be made to adapt a particular situation or material to the teachings of the embodiments without departing from the scope thereof. Therefore, it is intended that the embodiments not be limited to the particular embodiment disclosed as the best mode contemplated, but that all embodiments falling within the scope of the appended claims are considered.

What is claimed is:

1. A fragmentable package for use in an explosive armament, the fragmentable package comprising an inner wall and an outer wall covering individual fragments comprising additively deposited layers of at least one of a selected metal and a composite that includes the selected metal, the deposited layers to interconnect individual fragments and to form a plurality of voids around an individual outer surface of the individual fragments and to the outer wall, the plurality of voids defining a separation of fragments when detonated, the individual fragments providing structural stiffness and strength independent of the outer wall wherein the inner wall is separated from the outer wall and the individual fragments being between the inner wall and the outer wall, wherein the inner wall and the outer wall comprise the additively deposited layers of the at least one of the selected metal and the composite that includes the selected metal.

2. The fragmentable package according to claim 1, wherein the individual fragments and the plurality of voids provide for a parasitic mass towards zero.

3. The fragmentable package according to claim 1, wherein the plurality of voids provide for a control of thermal conductivity of the fragmentable package based on at least one of a volume of the plurality of voids and a conductivity of the plurality of voids.

4. The fragmentable package according to claim 1, wherein the individual fragments comprises first fragments and second fragments wherein the first fragments are larger in size than the second fragments and the second fragments surround the first fragment between the outer wall and a side of the first fragment adjacent to the outer wall.

5. The fragmentable package according to claim 1, wherein the individual fragments comprise a plurality of fragment shapes wherein the plurality of fragment shapes comprises at least one symmetric fragment shape and a non-symmetric fragment shape.

6. The fragmentable package according to claim 1, further comprising a filler material located within at least one void of the plurality of voids.

7. The fragmentable package according to claim 6, wherein the filler material is provided to absorb energy.

8. The fragmentable package according to claim 6, wherein the filler material is provided to at least one of increase a projection velocity of individual fragments of the fragmentable package and increase a blast overpressure of the fragmentable package.

9. The fragmentable package according to claim 6, wherein the filler material comprises at least one of a phase-change material, coolant, propellant, a reactant material, and an energetic material.

10. The fragmentable package according to claim 1, wherein at least one void of the plurality of voids is configured to receive a wire through the void.

11. The fragmentable package according to claim 1, Wherein at least one void of the plurality of voids comprises at least one of an empty space, a partly sintered space, and porous material within a space.

12. The fragmentable package of claim 1, further comprising at least one interconnector located between adjacent individual fragments, the interconnector formed by additively depositing layers wherein the interconnector comprises smaller sized structure than the individual fragments.

13. The fragmentable package according to claim 1, wherein a thickness of the at least one of the inner wall and the outer wall provides a minimal structural stiffness and strength.

14. The fragmentable package of claim 1, further comprising at least one interconnector located between at least one of the inner wall and the outer wall and an adjacent individual fragment, the interconnector formed by additively depositing layers wherein the interconnector comprises a structured size that is smaller than the individual fragment.

15. A method, comprising:

additively depositing a plurality of layers, of at least one of a selected metal and a composite that includes the selected metal, to create a fragmentable package for an explosive having an inner wall, an outer wall and a pattern of individual fragments with voids between individual fragments and the outer wall, the voids defining a separation of the individual fragments when exploded wherein the inner wall is separated from the outer wall and the individual fragments being between the inner wall and the outer wall, wherein the inner wall and the outer wall comprise the additively deposited layers, of the at least one of the selected metal and the composite that includes the selected metal; and controlling positioning of a deposition of the plurality of layers to build a structure with the outer wall and the pattern so that the fragmentable package provides for a structural stiffness and strength sufficient for use with a delivery system.

16. The method according to claim 15, further comprising at least one of injecting, chemically or electrically depositing and casting a filler material into the voids to provide for at least one of a cooling effect, to enhance an explosive effect to create increased velocity of individual fragments of the fragmentable package and to increase blast overpressure of the fragmentable package.

17. The method according to claim 15, wherein the inner wall and the outer wall have a thickness to provide a minimal structural stiffness and strength sufficient for use with the delivery system.

18. The method according to claim 17, wherein the additively depositing the plurality of layers to create the fragmentable package includes creating the inner wall such that the individual fragments are between the inner wall and the outer wall and further comprising creating voids between the inner wall and the individual fragments.

19. The method according to claim 15, further comprising varying at least one controlled variable structural parameter during the additively deposition of layers at a specific location in the fragmentable package, the at least one controlled variable structural parameter comprises material composition, variable thickness, variable density, variable material homogeneity, and variable hardness.

20. A fragmentable package for use in an explosive armament, the fragmentable package comprising an inner wall and an outer wall covering individual fragments comprising additively deposited layers of at least one of a selected metal and a composite that includes the selected metal, the deposited layers to interconnect individual fragments and to form a plurality of voids around an individual outer surface of the individual fragments and to the outer wall, the plurality of voids defining a separation of fragments when detonated, the individual fragments providing structural stiffness and strength independent of the outer wall, wherein the individual fragments comprise first fragments and second fragments, wherein the first fragments are larger in size than the second fragments and the second fragments surround the first fragments between the outer wall and a side of the first fragments adjacent to the outer wall.

* * * * *